United States Patent [19]

Hasty

[11] 4,091,804

[45] * May 30, 1978

[54] COMPRESSION SLEEVE

[75] Inventor: James H. Hasty, Cary, Ill.

[73] Assignee: The Kendall Company, Boston, Mass.

[ * ] Notice: The portion of the term of this patent subsequent to June 21, 1994, has been disclaimed.

[21] Appl. No.: 749,494

[22] Filed: Dec. 10, 1976

[51] Int. Cl.[2] ..... A61H 1/00

[52] U.S. Cl. ..... 128/24 R; 128/40; 128/82.1; 128/DIG. 15; 128/64

[58] Field of Search ... 128/24 R, 60, 64, 299DIG. 20, 128/25 R, DIG. 15, 89 R, 38–40, 82.1, 24.1

[56] References Cited

U.S. PATENT DOCUMENTS

| | | | |
|---|---|---|---|
| 3,391,692 | 7/1968 | Spielberg | 128/24 R |
| 3,701,349 | 10/1972 | Larson | 128/82.1 |
| 3,920,006 | 11/1975 | Lapidus | 128/82.1 |
| 4,030,488 | 6/1977 | Hasty | 128/24 R |

*Primary Examiner*—Lawrence W. Trapp
*Attorney, Agent, or Firm*—Powell L. Sprunger

[57] ABSTRACT

A compression sleeve for applying compressive pressures against a patient's limb from a source of pressurized fluid. The sleeve has a plurality of separate fluid pressure chambers arranged longitudinally along the sleeve, and a sizer portion located intermediate a pair of adjoining pressure chambers to permit adjustment of the sleeve to limbs of varying sizes. The sizer portion may comprise a ventilation chamber having a plurality of openings for ventilating the patient's limb with air during use of the sleeve.

6 Claims, 6 Drawing Figures

58
26
58
34a
34b
20
22
S

44'
58
40b
48e
26
60
50'
46
44"
60
58
48d
36
44

26
42a
48f
60
48e
58
62
50
44'
40b
44"
46
48d
46
48c
48b
48a
42b
36
40a 54
26
36
50
52
52
44"
44'
48e
48d
38

48f
42a
26
44
44'
4
48e
60
50
52
40b
38
44"
4
48d
48c
46
46
40a
48b
48a
42b 48e
44'
38
36
52
26
50
52
44"
48d

COMPRESSION SLEEVE

BACKGROUND OF THE INVENTION

The present invention relates to therapeutic and prophylactic devices, and more particularly to sleeves for applying compressive pressures against a patient's limb.

It is known that the velocity of blood flow in a patient's extremities, particularly the legs, markedly decreases during confinement of the patient. Such pooling or stasis of blood is particularly pronounced during surgery, immediately after surgery, and when the patient has been confined to bed for extended periods of time. It is also known that stasis of blood is a significant cause leading to the formation of thrombi in the patient's extremities, which may have a severe deleterious effect on the patient, including death. Additionally, in certain patients it is desirable to move fluid out of interstitial spaces in extremity tissues, in order to reduce swelling associated with edema in the extremities.

Devices have been proposed for use in increasing the velocity of blood flow through the patient's limbs and minimizing edema, such as the devices disclosed in applicant's copending applications Ser. Nos. 625,990 now U.S. Pat. No. 4,013,069 and 626,018 now U.S. Pat. No. 4,030,488, filed Oct. 28, 1975, and incorporated herein by reference. These devices comprise a compression sleeve and a controller for sequentially inflating and deflating pressure chambers in the sleeve. It is desirable that such sleeves may be adjusted to the size of a particular patient in order to permit use of the sleeve on patients of varying leg sizes. Additionally, the sleeves may tightly enclose the patient's limb, and it is desirable to increase ventilation of the patient's limb beneath the sleeve.

SUMMARY OF THE INVENTION

A principal feature of the present invention is the provision of an improved compression sleeve for applying compressive pressures against a patient's limb.

The sleeve of the present invention comprises, a plurality of separate fluid pressure chambers arranged longitudinally along the sleeve, and a sizer portion located intermediate a pair of adjoining pressure chambers. The sizer portion has a sufficient length to permit adjustment of the sleeve between a first position with the adjoining chambers being spaced apart a relatively small distance and a second position with the adjoining chambers being spaced from each other a relatively large distance.

A feature of the present invention is that the sizer portion permits adjustment of the sleeve pressure chambers on limbs of varying sizes.

Another feature of the present invention is that the sizer portion may comprise a ventilation chamber having a plurality of openings communicating with the ventilation chamber and facing the patient's limb.

Thus, a feature of the present invention is that air may be passed into the ventilation chamber and through the openings to ventilate the patient's limb during use of the sleeve.

Further features will become more fully apparent in the following description of the embodiments of this invention and from the appended claims.

DESCRIPTION OF THE PREFERRED EMBODIMENTS

Figure 1:
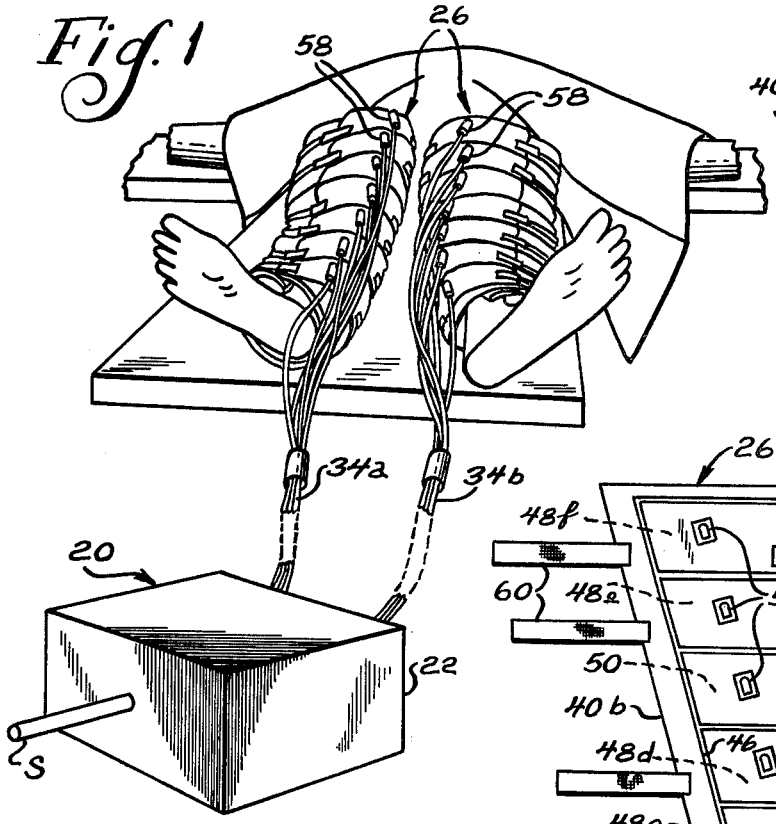
FIG. 1 is a perspective view of a compression device having a pair of compression sleeves of the present invention.

Referring now to FIG. 1, there is shown a compression device generally designated 20 for applying compressive pressures against a patient's extremities, such as the legs. The compression device 20 has a control apparatus 22, and a pair of compression sleeves 26 for enclosing lengths of the patient's legs. As disclosed in applicant's copending applications Ser. Nos. 625,990 and 626,018, the control apparatus intermittently forms one or more fluid pressure pulses from a source S of pressurized gas during periodic compression or inflation cycles, and the pulses are separately applied to the sleeves 26 through two sets of conduits **34*a* and 34*b* which are separately connected to the sleeves. Also, the sleeves are intermittently deflated by the control apparatus 22** during periodic deflation or decompression cycles between the compression cycles.

Figure 2:
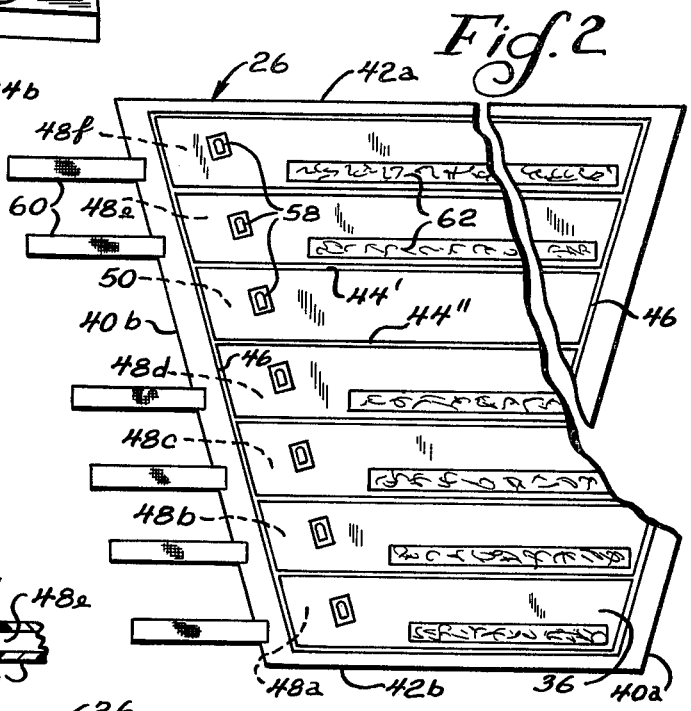
FIG. 2 is a fragmentary front plan view of the compression sleeve of FIG. 1.
Figure 5:
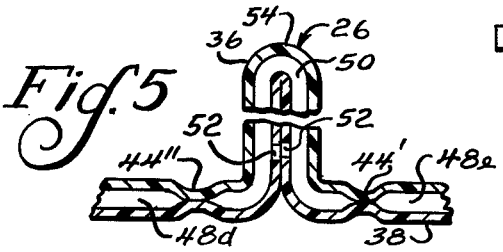
FIG. 5 is a sectional view of a sizer portion in the sleeve as folded to reduce the length of the sleeve.
Figure 3:
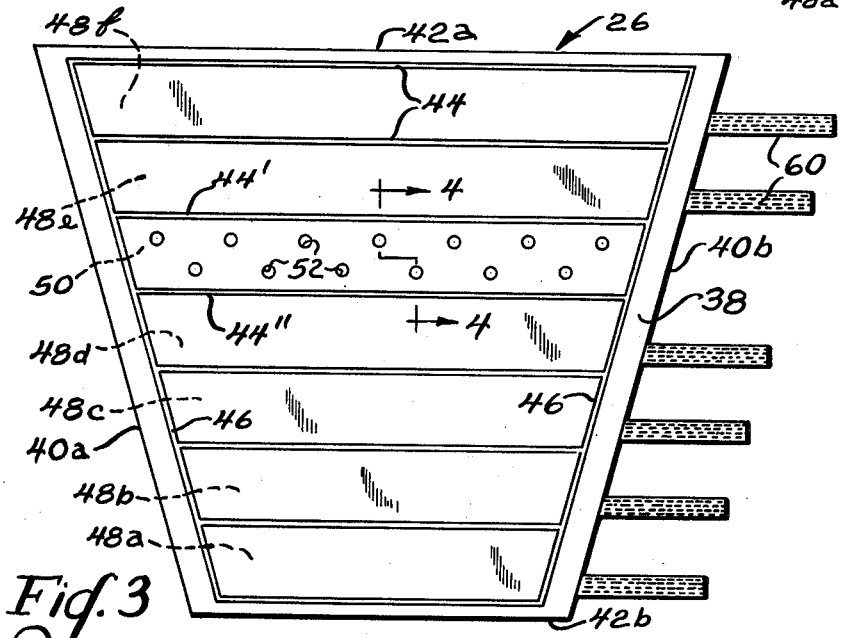
FIG. 3 is a back plan view of the sleeve of FIG. 2.
Figure 4:
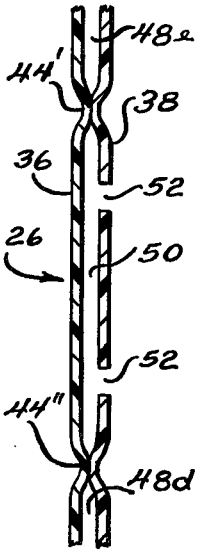
FIG. 4 is a sectional view taken substantially as indicated along the line 4—4 of FIG. 3.

As shown in FIGS. 2–4, the sleeves 26 have a pair of flexible outer and inner sheets 36 and 38 which are made from a fluid impervious material, such as polyvinyl chloride. The sheets 36 and 38 have a pair of side edges **40*a* and 40*b*, and a pair of end edges 42*a* and 42*b* connecting the side edges 40*a* and *b*. As shown in FIGS. 3 and 4, the sheets have a plurality of laterally extending lines 44, such as lines of sealing, and a pair of longitudinally extending lines 46, such as lines of sealing, connecting the sheets 36 and 38 together and connecting ends of the lateral lines 44, as shown. The connecting lines 44 and 46 define a plurality of pressure chambers 48*a*, 48*b*, 48*c*, 48*d*, 48*e*, and 48*f* which extend laterally in the sheet, and which are disposed longitudinally in the sleeve between the end edges 42*a* and 42*b*. When the sleeve is placed on the patient's leg, the lowermost chamber 48*a*** is located on a lower part of the leg adjacent the patient's ankle, while the uppermost chamber is located on an upper part of the leg adjacent the mid-thigh.

As shown, the sleeve 26 has a pair of lines 44' and 44" defining a ventilation chamber or sizing portion 50 which extends between the adjoining pressure chambers **48*d* and 48*e*, such that the ventilating chamber 50 separates the pressure chambers into a set of lower contiguous chambers 48*a*, *b*, *c*, and *d*, and a set of upper contiguous chambers 48*e* and *f*. The inner sheet 38 has a plurality of ventilation openings 52 extending through the sheet 38 and communicating with the ventilation chamber 50. In addition, the ventilation chamber 50 has a sufficient length to permit movement of the sleeve between a first position with the adjoining chambers 48*d* and *e* being spaced apart a relatively small distance and a second position with the adjoining chambers 48*d* and *e* being spaced from each other a relatively large distance. In one form, the ventilating chamber 50 may have a length approximately the same as the pressure chambers 48***a–f*.

In a preferred embodiment, the side edges 40*a* and 40*b* and the connecting lines 46 are tapered from the end edge 42*a* toward the end edge 42*b*. Thus, the sleeve 26 has a reduced configuration adjacent its lower end to facilitate placement of the sleeve on the more narrow regions of the leg adjacent the patient's ankles. Moreover, it will be seen that the connecting lines 44 and 46 define chambers having volumes which progressively increase in size from the lowermost pressure chamber 48*a* to the uppermost pressure chamber 48*f*. The relative size of the chambers facilitates the device to develop a compressive pressure gradient during the compression or inflation cycles which decreases from a lower part of the sleeve adjacent the end edge 42*b* toward an upper part of the sleeve adjacent the end edge 42*a*. As shown in FIG. 2, the sleeves 26 have a plurality of connectors 58 which are secured to the sheet 36 and which communicate with the separate pressure chambers and ventilation chamber in the sleeve 26. As illustrated in FIG. 1, the connectors 58 are secured to the conduits 34*a* and *b*, such that the conduits separately communicate with the pressure chambers and ventilation chamber in the sleeve through the connectors 58.

As best shown in FIGS. 2 and 3, the sleeves 26 may have a plurality of hook and loop strips 60 and 62, respectively, to releasably secure the sleeves about the patient's legs. The hook strips 60 extend past one of the side edges 40*b* of the sleeve, while the loop strips 62 are secured to the outside of the outer sheet 36. During placement, the sleeves 26 are wrapped around the patient's legs with the inner sheet 38 and ventilating openings 52 facing the legs, and the hook strips 60 are releasably attached to the associated loop strips 62 on the outside of the sleeves in order to secure the sleeves on the legs and confine movement of the sleeves away from the patient's legs when inflated during operation of the device.

In use, the control apparatus 22 intermittently inflates the pressure chambers 48*a–f* in a manner producing a compressive pressure gradient which progressively decreases from a lower to upper portion of the sleeve. After the compression cycles have been completed, the control apparatus 22 deflates the pressure chambers during periodic decompression cycles between the compression cycles, after which the control apparatus 22 repeats the compression cycles.

In addition, the control apparatus passes air through the conduits 34*a* and *b* associated with the ventilation chambers 50 in the sleeves 26, and the air passes from the ventilation chambers 50 through the openings 52 against the patient's legs. In this manner, the compression device 20 causes passage of air between the sleeves 26 and the patient's limbs in order to ventilate the patient's legs during use of the device. The air may be continuously supplied to the ventilating chambers, or, if desired, only during the decompression cycles when the sleeves are more loosely fitted about the limbs.

The ventilation chamber 50 also comprises a sizing portion of the sleeve in order to permit adjustment of the sleeve on limbs of varying lengths. Thus, for a patient having relatively long legs, the sleeves 26 are secured about the patient's limbs with the ventilation chambers 50 in a generally planar configuration such that the adjoining chambers 48*d* and *e* are spaced apart a relatively large distance in their second position. For a patient having relatively short legs, the ventilation chambers or sizing portions 50 are folded about a laterally extending central fold line 54, such that the effective length of the sleeves 26 between the adjoining chambers 48*d* and *e* is reduced in their first position. Thus, the sleeves 26 are secured about the patient's legs with the sizing portions 50 folded into a configuration of reduced longitudinal dimensions, and with the pressure chambers located at the proper position on the patient's legs. In this manner, the compression sleeves 26 may be readily adjusted to the particular size of the patient's limbs in order to obtain proper placement of the pressure chambers on the patient's limbs and minimize the number of sleeves of differing lengths which would otherwise be required to properly fit patients of varying leg sizes. In a preferred form, the sleeve sizing portions 50 are located in the region of the patient's knees whether the sleeves are secured about the patient's legs in their reduced or enlarged configuration.

Figure 6:
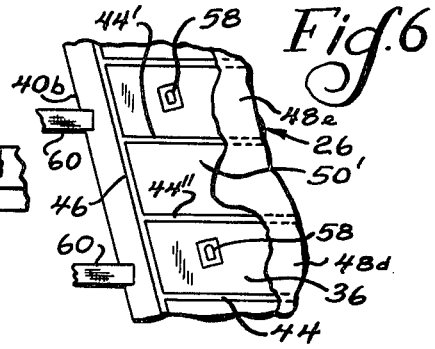
FIG. 6 is a fragmentary front plan view of another embodiment of the sleeve of the present invention.

Another embodiment of the present invention is illustrated in FIG. 6, in which like reference numerals designate like parts. In this embodiment, the sizing portion 50' is uninflated during use of the device. The sizing portion may comprise a closed chamber, or, if desired, may comprise a seal extending between the adjoining chambers 48*d* and *e*. The sizing portion 50' may be utilized to shorten or lengthen the compression sleeves for patients with varying leg sizes in a manner as previously described.

The foregoing detailed description is given for clearness of understanding only, and no unnecessary limitations should be understood therefrom, as modifications will be obvious to those skilled in the art.

I claim:

1. A device for applying compressive pressures against a patient's limb from a source of pressurized fluid, comprising:

an elongated pressure sleeve for enclosing a length of the patient's limb, said sleeve having a plurality of separate fluid pressure chambers progressively arranged longitudinally along the sleeve from a lower portion of the limb to an upper portion of the limb proximal the patient's heart relative said lower portion, said sleeve including flexible sizer means extending between a pair of adjoining chambers and having a sufficient length to permit adjustment of the sleeve on limbs of varying sizes between a first position with said adjoining chambers being spaced apart a relatively small distance and a second position with said adjoining chambers being spaced from each other a relatively large distance, said sizer means being uninflated during use of the device; and means for intermittently inflating and deflating said compression chambers.

2. The device of claim 1 wherein said sleeve includes a set of contiguous lower and upper chambers, and in which the sizer means separates the lower and upper chamber sets.

3. The device of claim 2 wherein said lower set comprises four contiguous chambers, and said upper set comprises two contiguous chambers.

4. A sleeve for applying compressive pressures against a patient's limb, comprising:

a pair of flexible sheets of fluid impervious material;

means for connecting said sheets together along lines defining a plurality of separate laterally extending inflatable chambers disposed longitudinally along the sleeve and defining a noninflatable sizer portion extending between a pair of adjoining chambers, said sizer portion having a sufficient length to permit adjustment of the sleeve on limbs of varying sizes between a first position with said adjoining chambers being spaced apart a relatively small distance and a second position with said adjoining chambers being spaced apart a relatively large distance; and means for releasably securing the sleeve about the patient's limb with said chambers and sizer portion encircling the limb.

5. A device for applying compressive pressures against a patient's limb from a source of pressurized fluid, comprising:

an elongated pressure sleeve for enclosing a length of the patient's limb, said sleeve having inner and outer flexible sheets defining a plurality of closed separate fluid pressure chambers arranged longitudinally along the sleeve, and a ventilation chamber separate from said pressure chambers having a plurality of openings for facing the patient's limb; and means for intermittently inflating and deflating said pressure chambers and for passing air into the ventilation chamber to ventilate the patient's limb through said openings.

6. A sleeve for applying compressive pressures against a patient's limb, comprising:

an inner flexible sheet of fluid impervious material;

an outer flexible sheet of fluid impervious material;

means for connecting said sheets together along lines defining a plurality of separate closed pressure chambers and a separate ventilation chamber between the sheets, said inner sheet having a plurality of openings communicating with the ventilation chamber to permit passage of air from the ventilation chamber onto the patient's limb; and means for releasably securing the sleeve about the patient's limb with the chambers encircling the limb.

* * * * *